United States Patent [19]

Fricke et al.

[11] 4,081,223

[45] Mar. 28, 1978

[54] CONTROL ARRANGEMENT FOR PREVENTING SYSTEM OVERLOAD

[75] Inventors: Hans-Jürgen Fricke, Stuttgart; Paul Bosch, Ludwigsburg, both of Germany

[73] Assignee: Robert Bosch GmbH, Stuttgart, Germany

[21] Appl. No.: 699,860

[22] Filed: Jun. 25, 1976

[30] Foreign Application Priority Data

Jul. 15, 1975 Germany ..... 2531492

[51] Int. Cl.[2] ..... F04B 49/00

[52] U.S. Cl. ..... 417/218; 60/449

[58] Field of Search ..... 417/15, 212, 218-222; 60/431, 445, 448, 449, 452

[56] References Cited

U.S. PATENT DOCUMENTS

| | | | |
|---|---|---|---|
| 2,502,546 | 4/1950 | Adams | 417/219 X |
| 3,523,419 | 8/1970 | Hindle | 60/448 |
| 3,921,503 | 11/1975 | Kubik | 417/218 X |
| 3,957,396 | 5/1976 | Cooper | 417/218 |
| 3,969,038 | 7/1976 | Nonnenmacher et al. | 417/218 |

FOREIGN PATENT DOCUMENTS

| | | | |
|---|---|---|---|
| 2,251,904 | 4/1974 | Germany | 60/449 |
| 2,350,766 | 7/1974 | Germany | 417/218 |
| 2,434,840 | 2/1975 | Germany | 417/218 |

*Primary Examiner*—William L. Freeh
*Assistant Examiner*—Edward Look
*Attorney, Agent, or Firm*—Michael J. Striker

[57] ABSTRACT

A control arrangement for preventing overloading of a prime mover which drives a pump comprises a pair of hydraulically operating adjusting units operative for adjusting the volume of fluid discharged by the pump. The arrangement further comprises a negative-feedback stabilizing circuit connected to the adjusting units and to a multi-setting regulating valve. The stabilizing circuit is operative for causing the valve to regulate the operation of the pump by controlling the operation of the adjusting units in dependence upon the output pressure of the pump. In order to protect the prime mover when the loading thereof has reached a predetermined value, an overload signal is generated which actuates an over-ride device. The override device is operative in response to the overload signal to cause the valve to assume a setting such that the adjusting units decrease the quantity of fluid discharged by the pump so as to unload the prime mover.

6 Claims, 2 Drawing Figures

27
45
47
48
49
51
31
I
II
III 10
11
12
13
14
15
16
17
18
19
20
21
22
23
25
26
27
28
28'
29
29'
30
31
32
33
34
34'
35
36
37
38
39
40
41
I
II
III

CONTROL ARRANGEMENT FOR PREVENTING SYSTEM OVERLOAD

BACKGROUND OF THE INVENTION

The present invention relates to a hydraulic control arrangement and, more particularly, to such an arrangement which prevents overloading of a prime mover which drives a pump.

It is known to prevent prime mover overload by providing a control arrangement having a sensing device which detects the residual gases of an engine and which is operative via a control member to adjust the quantity of fuel injected to the engine by a fuel-injecting device. However, such control arrangements have not proven altogether satisfactory since they require many different control devices in order to obtain the desired effect and are therefore rather expensive, susceptible to noise and interference, and are not capable of precise and reliable operation.

SUMMARY OF THE INVENTION

Accordingly, it is a general object of the present invention to overcome the disadvantages of the prior art.

It is another object of the present invention to provide a control arrangement which reliably protects a prime mover which drives at least one pump from overloading.

An additional feature of the present invention is to provide a control arrangement which reliably generates an overload signal and, in response to said signal, reliably unloads the prime mover.

In keeping with these objects and others which will become apparent hereinafter, one feature of the invention, briefly stated, is embodied in a control arrangement for preventing the overloading of a prime mover which drives a pump that comprises a pair of hydraulically-operating adjusting units which are operative for adjusting the volume of fluid discharged by the pump. The arrangement further comprises a negative-feedback stabilizing circuit which is connected to the adjusting units and to a multi-setting regulating valve. The stablizing circuit is operative for causing the valve to regulate the operation of the pump by controlling the operation of the adjusting units in dependence upon the output pressure of the pump. In order to protect against overloading of the prime mover, means are provided which are operative for generating an overload signal when the loading of the prime mover has reached a predetermined value. Anti-overload override means are operative in response to the overload signal for causing the value to assume a setting such that the adjusting units decrease the quantity of fluid discharged by the pump.

The overload signal may be generated by the closing of an electrical switch so as to generate an electrical signal which is employed is energizing an electromagnet for causing the valve to assume the aforementioned setting, or by the sensing of the distance through which a control member has moved so as to generate an electrical signal which is again employed in energizing an electromagnet.

In a currently preferred embodiment, the prime mover is a fuel-combusting machine, such as a diesel or an Otto-type motor. In accordance with the invention, stalling of the engine by excessive loading caused by the pump is reliably counteracted.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
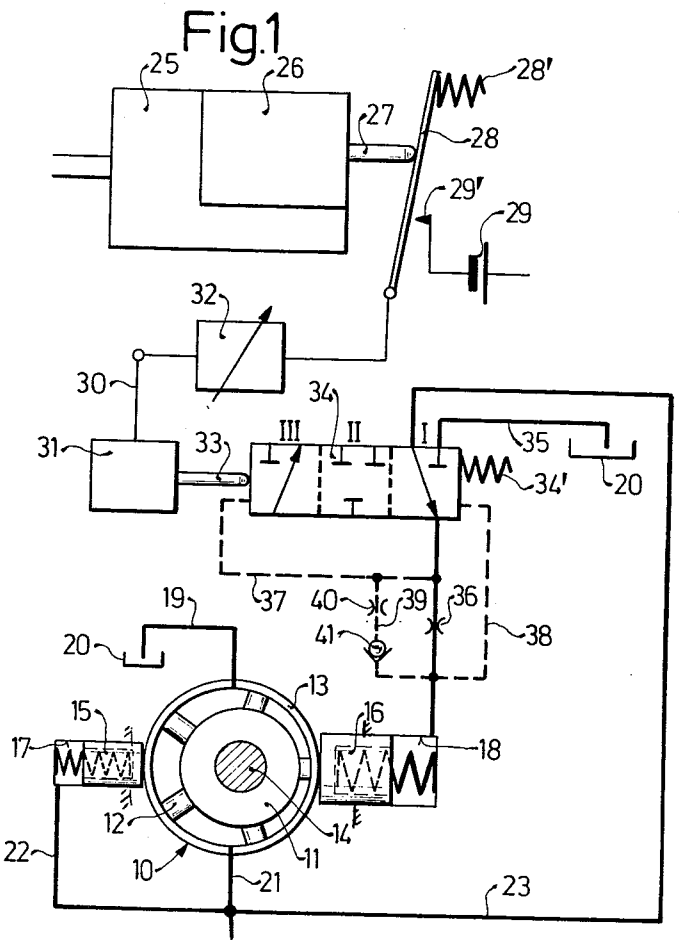
FIG. 1 is a diagrammatic view of a preferred embodiment of the control arrangement in accordance with the present invention.

Referring firstly to FIG. 1 of the drawing, reference numeral 10 generally identifies the pump or means for transporting fluid, preferably but not necessarily a radial-piston, variable-output type pump. Pump 10 comprises a pintle 14, a cylinder block or rotor 11 which revolves about the axis of pintle 14 and which is formed with cylindrical bores in which the displaceable members or pistons 12 are movably mounted and arranged in star-shaped configuration, and a slide block 13 which is used to control the length of the piston strokes. A drive or prime mover 25 is coupled to the pump 10 for rotatably driving the rotor 11.

The amount of fluid pumped by pump 10 is variable and is selectively determined by the amount of distance provided between the centers of the slide block 13 and the cylinder block 11. This difference in distance determines the length of the piston stroke which, in turn, controls the amount of fluid flowing from the fluid reservoir 20 into the intake conduit 19 to be admitted into the input side of the pump 10 and, thereupon, from the cylindrical bores towards the high pressure side or outlet conduit 21 through which the fluid is conducted towards a non-illustrated consumer.

This adjustment of the distance between the centers of the slide block 13 and the cylindrical block 11 is automatically controlled to accommodate varying volume requirements during the operating cycle by hydraulically-controlled adjusting units comprised of a large piston 16 and a relatively smaller piston 15 which are respectively slidably movable in cylindrical cavities or bores 18 and 17. Pistons 16 and 15 contact opposite sides of the slide block 13 and, depending upon the difference in hydraulic pressure exerted by these pistons, the aforementioned distance between centers is adjusted. Pistons 16 and 15 are constantly urged against the sides of the block 13 by the biasing action of the illustrated springs, each having one end region in abutment with a closed end of the bores and another end region received in an internally-formed recess located within the pistons 16 and 15.

The operation of pump 10 is stabilized by negative-feedback. Thus, conduit 22 permits the constant communication of bore 17 with the pump output side 21; and conduit 23 permits communication between the bore 18 and the pump output side 21 depending upon the particular setting of the multi-setting valve means 34.

The diagrammatically illustrated valve means 34 is of the type having three settings I, II, III and three ports.

In setting I, the valve 34 permits communication from output side 21 to bore 18 via conduit 23. Thus, in normal operation, depending upon the particular loading condition, for example on the number of consumer applications, the pistons 15 and 16 will slide in their bores and move the block 13 to a position corresponding to the required loading condition.

The prime mover or drive 25, for example a diesel or Otto-type motor or any fuel-combusting engine, drives the pump 10 preferably but not necessarily by a common shaft. As noted above, the invention relates to protecting this drive from overloading, particularly when sudden changes in loading conditions which cause sudden torque changes tend to overstress the drive shaft. Such excessive loading conditions can occur from a variety of factors; for example, when there is a sudden need for a great quantity of fluid to be transported because of an increased number of consumer applications, or because an obstruction has developed downstream of the pump, or because more than one pump is connected to the output of the prime mover.

To protect the drive when its loading has reached a predetermined value, for example an overload value, an overload signal is generated. The means for producing this signal includes an electrical switch having a movable contact portion 28 and a stationary contact portion 29' which is connected in series with an electrical source 29, shown as a battery. A control member or pin 27 is connected to a fuel-injecting device 26 and is movable so as to urge contact portion 28 into direct electrical contact with stationary contact portion 29' and thereby generate an electrical overload signal. This signal is conducted via electrical conductor 30 through a variable resistor 32, which is operative to selectably control the magnitude of the signal, to energize electromagnet 31. When energized, the armature 33 of electromagnet 31 displaces valve member 34 so that it now assumes setting III. In setting III, the bore 18 communicates via conduit 35 with the reservoir 20. The electromagnet 31 thus constitutes part of the anti-overload override means which causes the pistons 15, 16 to decrease the quantity of fluid discharged by pump 10.

To briefly summarize the operation of the override feature, assume the valve member 34 is initially in setting I and the pump 10 is running at normal loading condition and discharging fluid to a consumer. A portion of the pressurized fluid flows through conduit 22 into bore 17; and another portion of the pressurized fluid flows through conduit 23 through valve member 34 to be received in bore 18. The piston 16 is larger than piston 15 so that the slide block 13 is initially pushed to the left in FIG. 1, thereby resulting in a longer piston stroke and a greater volumetric discharge of fluid.

If the torque of the drive reaches or nears a predetermined overload value, then the movement of the control pin 27 will generate an electrical signal by closing the electrical switch 28, 29'. This overload signal energizes the electromagnet 31 and sets valve member 34 to setting III. In this setting, the pressureized fluid flowing out from bore 18 is conducted towards reservoir 20. This permits the fluid in bore 17 which has a relatively higher pressure than the fluid in bore 18 to displace slide block 13 to the right, thereby reducing the volumetric fluid discharge of the pump 10 which results in an unloading of the drive 25.

As the drive 25 is unloaded, the control pin 27 moves back towards the left, and electrical contact is broken by the spring 28' which moves the movable contact 28 out of electrical contact with the stationary contact portion 29'. As a result, the electromagnet 31 is now deenergized and the spring 34' moves the valve member 34 back from setting III towards either setting II or setting I depending upon the control pressures existing in the hydraulic circuit which acts on the opposite ends of the valve member 34.

Intermediate the valve member 34 and the bore 18, a flow-restricting element 36 is provided in conduit 23. Conduit 37, diagrammatically shown in dashed lines, communicates the upper side of element 36 with one end of the valve member 34; and conduit 38, also diagrammatically shown in dashed lines, communicates the lower side of element 36 with the opposite end of valve member 34. A further conduit 39 is connected intermediate conduits 37 and 38 and is provided with another flow-restricting element 40 and a check valve 41 which only permits fluid to flow from bore 18 towards conduit 37.

The flow-restricting elements are operative to prevent large oscillations in the adjustment of the position of the slide block 13, i.e., it is undesirable to have the pistons 15, 16 too suddenly shift the slide block 13 since operational instability will result. Thus, the flow-restricting elements are operative to generate a pressure differential across its inlet and outlet sides whose magnitude will depend upon the speed of the fluid flowing through the flow-restricting element. Thus, if fluid in conduit 23 is flowing from output side 21 towards bore 18 at valve setting I, then the speed of the fluid passing through element 36 will develop a higher control pressure at the inlet or upper side of element 36 as compared with the control pressure existing at the outlet or lower side of element 36. These control pressures will push valve member 34 from its initial setting I towards setting II in direction against the force of spring 34'. In setting II, all fluid flow in conduit 23 is interrupted. Thus, instead of having a too sudden filling of the bore 18, the filling is intermittently achieved in incremental steps. Similarly, flow-restricting elements 40 and 36 are operative to dampen the flow of fluid flowing out of bore 18.

In operation, the valve member 34 can operate between any one of settings I, II or III so long as the electromagnet 31 is not energized because of the presence of the control pressures. Only when electromagnet 31 is energized, will the valve 34 be fixedly set in setting III to empty the bore 18 and assure unloading of the drive.

Figure 2:
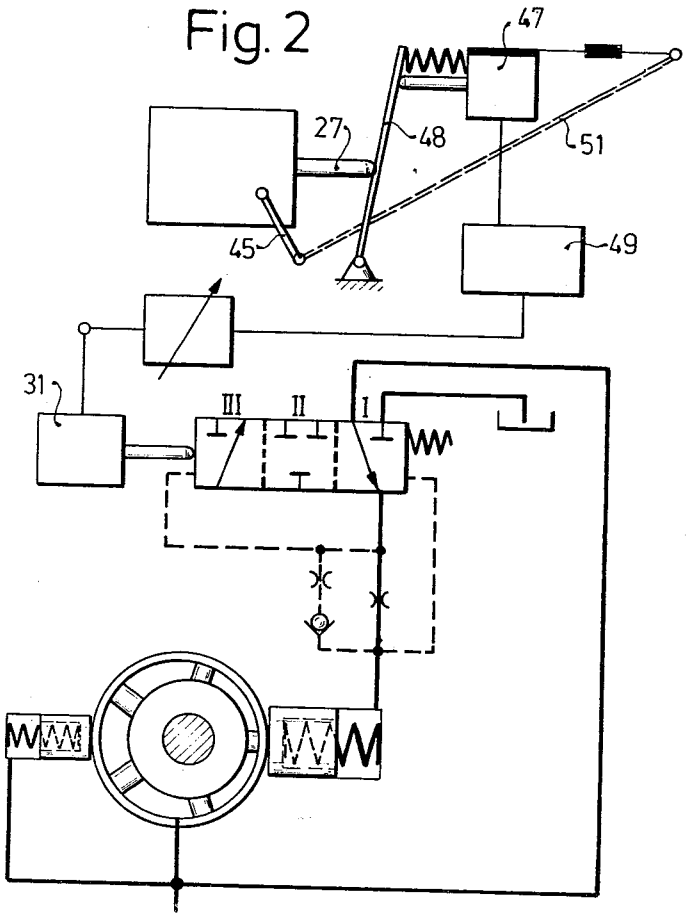
FIG. 2 is a diagrammatic view of another preferred embodiment of the control arrangement in accordance with the present invention.

The embodiment of FIG. 2 is analogous to that of FIG. 1, except for the means operative for generating the overload signal. Instead of providing that the movable control member 27 associated with the fuel-injection device closes an electrical switch, this embodiment proposes that the control member 27 engages a lever 48 having one end region pivotably mounted to a stationary support and its other end region is abutment with a motion detecting or pick-up device 47. The device 47 is operative to generate an electrical signal which is a function of the distance through which the control member 27 has moved. The electrical signal is modified by a differentiator 49 which electrically converts the output signal of the device 47 into a signal which is a time function of the change in speed of the control member 27. This latter signal is used to timely energize the electromagnet 31 independently of the magnitude of the signal. If the rate of change of speed of the signal as derived from the detecting device 47 is large, then the electromagnet 31 has sufficient time to be energized before the control member 27 has reached its maximum end position. For smaller rates of changes in speed, the electromagnet 31 is also controlled before the control member 27 has reached its maximum end position, but at a time somewhat later than in the previous case.

Thus, large variations of the moment at which the electromagnet is energized are prevented by utilizing the electrical signal which is a function of the rate of change of speed of the control member. In accordance with the invention, the operation is made very stable.

An adjustable mechanical connecting member 51 is located between the rpm adjusting lever 45 and the detecting device 47. The member 51 is operative to displace the device 47 and adjust it for rated speed. The position of the control member 27 and the moment at which the electromagnet 31 is energized will thus depend on the rpm of the drive. This feature stabilizes the operation of the control arrangement.

It will be understood that each of the elements described above, or two or more together, may also find a useful application in other types of systems differing from the types described above.

While the invention has been illustrated and described as embodied in a control arrangement for preventing prime mover overloads, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a combination with pump means and a prime mover driving the pump means, a control arrangement for preventing prime mover overload, the control arrangement comprising hydraulically-operating adjusting means operative for adjusting the volume of fluid discharged by said pump means said adjusting means including a pair of hydraulic units, each having a piston mounted for movement in a respective bore; a pair of conduit means, each having one end connected to a respective one of said bores and another end connected to the output pressure side of said pump; multi-setting valve means connected to said adjusting means and operative for controlling the operation thereof in dependence upon the setting of said valve means, said multi-setting valve means including a reservoir and a valve member movable between one setting in which said bore connected to one of said conduit means is in hydraulic communication with said output pressure side of said pump, and another setting in which said bore connected to said one conduit means is in communication with said reservoir; means operative for generating an overload signal when the loading of said prime mover has reached a predetermined value; means operative in response to said overload signal for counteracting prime mover overload by causing said valve means to activate said adjusting means; and flow-restricting means including a flow-restricting element in said one conduit means and operative for generating a pressure differential at the inlet and outlet sides of said flow-restricting element, said flow-restricting means further including means for moving said valve member to an additional setting in which communication is interrupted between said bore connected to said one conduit means and both said reservoir and said output pressure side of said pump, said moving means comprising a pair of auxiliary conduits each having one end connected to a respective side of said flow-restricting element and its opposite end connected to a respective side of said valve member.

2. The control arrangement of claim 1, wherein said overload signal generating means comprises a movable control member and sensing means operative for generating an electrical signal in response to the movement of said control member; and wherein said counteracting means comprises means operative in response to said electrical overload signal for electromagnetically actuating said valve means to assume a setting such that said adjusting means decreases the quantity of fluid discharged by said pumping means.

3. The control arrangement as defined in claim 2, wherein said sensing means comprises electrical switching means.

4. The control arrangement as defined in claim 1; and further comprising an additional conduit connected between said pair of auxiliary conduits, and wherein said flow-restricting means includes another flow-restricting element in said additional conduit; and further comprising a check valve in said additional conduit.

5. The control arrangement as defined in claim 1, wherein said pump means comprises a movable slide block, and wherein said adjusting means comprises a pair of hydraulic units, each having a piston mounted for movement in a bore and being mounted at diametrically opposite sides of said slide block for moving the latter to regulate the operation of said pump means, and wherein one of said pistons is smaller than the other of said pistons, and the respective bore which receives said one smaller piston is in constant communication with the output pressure side of said pump means.

6. In a combination with pump means and a prime mover driving the pump means, a control arrangement for preventing prime mover overload, the control arrangement comprising hydraulically-operating adjusting means operative for adjusting the volume of fluid discharged by said pump means; multi-setting valve means connected to said adjusting means and operative for controlling the operation thereof in dependence upon the setting of said valve means; means operative for generating an overload signal when the loading of said prime mover has reached a predetermined value, said signal generating means including a movable control member and sensing means having electrical switching means and operative for generating an electrical signal in response to the movement of said control member; means operative in response to said overload signal for counteracting prime mover overload by causing said valve means to activate said adjusting means, said counteracting means including means operative in response to said electrical overload signal for electromagnetically actuating said valve means to assume a setting such that said adjusting means decreases the quantity of fluid discharged by said pump means; and a variable resistor connected in series with said electromagnetically-actuating means for selectively varying the magnitude of said overload electrical signal.

* * * * *